US009374884B2

(12) United States Patent
Mitra

(10) Patent No.: US 9,374,884 B2
(45) Date of Patent: Jun. 21, 2016

(54) BASIC ELECTROMAGNETIC FORCE FIELD

(76) Inventor: Manu Mitra, Walnut Creek, CA (US)

( * ) Notice: Subject to any disclaimer, the term of this patent is extended or adjusted under 35 U.S.C. 154(b) by 1039 days.

(21) Appl. No.: 13/526,460

(22) Filed: Jun. 18, 2012

(65) Prior Publication Data

US 2015/0305132 A1 Oct. 22, 2015

(51) Int. Cl.

| | |
|---|---|
| ***B05D 3/14*** | (2006.01) |
| ***H05H 1/24*** | (2006.01) |
| ***F03H 1/00*** | (2006.01) |
| ***H05H 1/48*** | (2006.01) |
| ***H05H 1/54*** | (2006.01) |

(52) U.S. Cl.

CPC ..... *H05H 1/24* (2013.01); *F03H 1/0081* (2013.01); *H05H 1/48* (2013.01); *H05H 1/54* (2013.01)

(58) Field of Classification Search

CPC ..... H05H 1/24; F03H 1/0081
USPC ..... 89/36.02
See application file for complete search history.

(56) References Cited

U.S. PATENT DOCUMENTS 3,735,591 A 5/1973 Burkhart
8,084,101 B2 * 12/2011 Das ..... B82B 3/00 427/472
8,887,663 B2 * 11/2014 Stebbins ..... B82Y 30/00 118/620
2009/0248113 A1 * 10/2009 Nimer ..... A61N 1/05 607/60
2012/0135158 A1 * 5/2012 Freer ..... B82Y 10/00 427/532
2012/0160997 A1 * 6/2012 Fink ..... H01J 49/10 250/282

OTHER PUBLICATIONS

Physics of the Impossible: A Scientific Exploration Into the World of Phasers, Force Fields, Teleportation, and Time Travel; Michio Kaku; Random House Digital, Inc.; First Edition; 2008; pp. 1-15; http://books.google.com/books?id=ube-MQcFFZQC&printsec=frontcover#v=onepage&q&f=false.

Online Article: Bullets harmlessly bouncing off nanotechnology T-shirts; Nov. 1, 2007; http://www.nanowerk.com/spotlight/spotid=3134.php.

Online Article: Magnetoplasmadynamic (MPD) Thruster Design, by Matthew Krolak; http://myelectricengine.com/projects/mpdthruster/mpdthruster.html.

* cited by examiner

*Primary Examiner* — Michael David
(74) *Attorney, Agent, or Firm* — Cionca Law Group P.C.; Marin Cionca

(57) ABSTRACT

An electromagnetic force field configured to protect designated assets against incoming objects, comprising a plurality of layers, wherein the layers are a member of a group consisting of a supercharged plasma window, a curtain of high-energy laser beams arranged in a lattice-like configuration, and a carbon nanotube (CNT) layer, wherein the laser beams are positioned at equal distance between each other and as such as to ensure that at least four laser beams are in the path of the smallest object, and wherein, the CNT layer comprises a plurality of CNT sheets.

10 Claims, 6 Drawing Sheets

BASIC ELECTROMAGNETIC FORCE FIELD

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISC APPENDIX

Not Applicable

BACKGROUND OF THE INVENTION

1. Field of the Invention

The invention relates generally to the high voltage electronics and more particularly to an improved electromagnetic force field.

2. Description of the Related Art

It is known in the art how to generate supercharged plasma, how to contain the supercharged plasma in a plasma window, how to generate high-energy laser beams, and how to make carbon nanotubes (CNT). In the same time there is often a need to protect certain civilian assets (e.g., buildings) or military assets (e.g., tanks) from incoming objects (e.g., projectile weapons). Thus, a protective/defensive system and method is needed that will address the need for assets protection and that will employ the technological advances enumerated above.

The problems and the associated solutions presented in this section could be or could have been pursued, but they are not necessarily approaches that have been previously conceived or pursued. Therefore, unless otherwise indicated, it should not be assumed that any of the approaches presented in this section qualify as prior art merely by virtue of their presence in this section of the application.

BRIEF SUMMARY OF THE INVENTION

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

In one exemplary embodiment an electromagnetic force field is provided, which is configured to protect designated assets against projectiles, and which include three layers, a supercharged plasma window as the first layer, a curtain of high-energy laser beams as the second layer and a plurality of CNT sheets as the third layer, and wherein the laser beams are positioned at equal distance between each other and as such as to ensure that at least four laser beams are in the path of the smallest object, and wherein, the CNT layer comprises a plurality of CNT sheets. Thus, an advantage is the ability to protect designated assets, such as buildings or military tanks, from projectile weapons.

The above embodiment and advantage, as well as other embodiments and advantages, will become apparent from the ensuing description and accompanying drawings.

BRIEF DESCRIPTION OF THE DRAWINGS

For exemplification purposes, and not for limitation purposes, embodiments of the invention are illustrated in the figures of the accompanying drawings, in which.

DETAILED DESCRIPTION OF THE PREFERRED EMBODIMENTS

Figure 1:
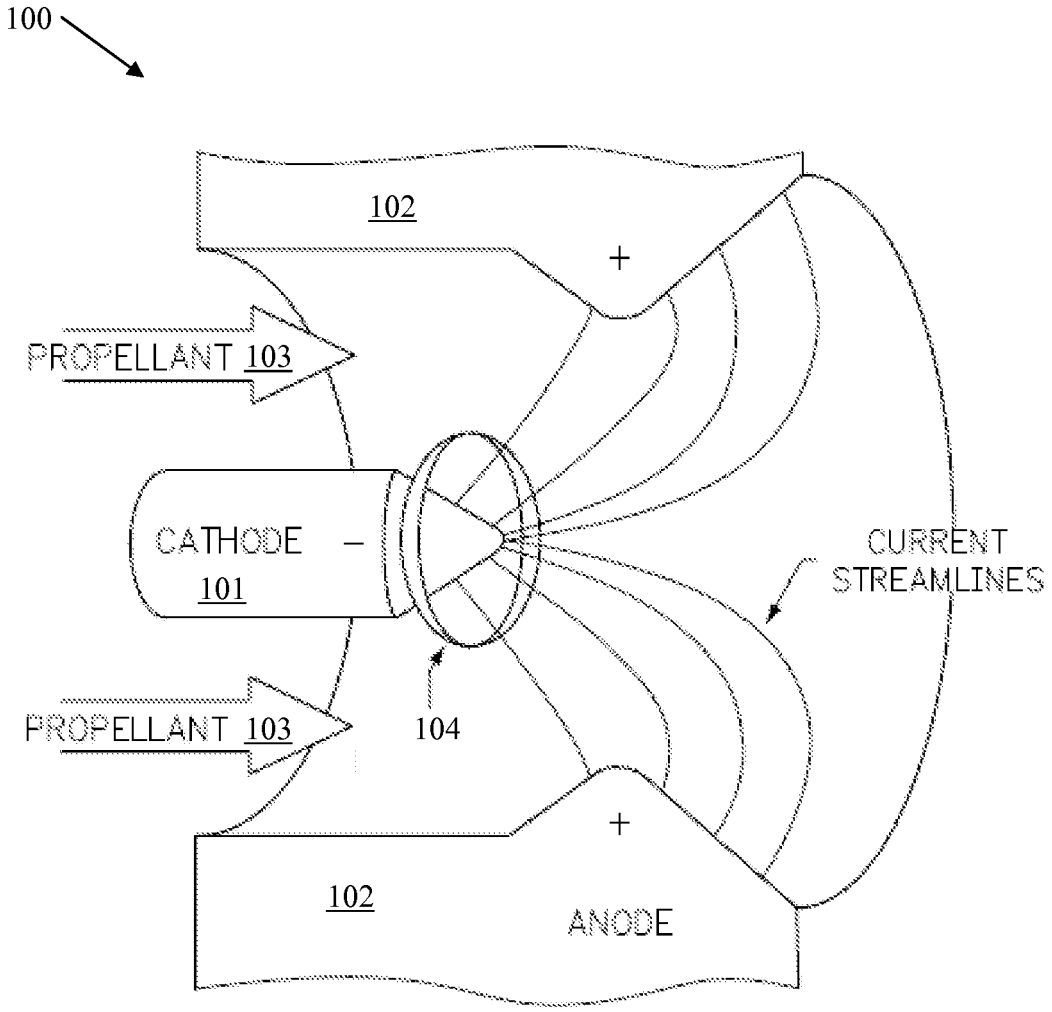
FIG. 1 illustrates the working principle of a plasma field generator.

What follows is a detailed description of the preferred embodiments of the invention in which the invention may be practiced. Reference will be made to the attached drawings, and the information included in the drawings is part of this detailed description. The specific preferred embodiments of the invention, which will be described herein, are presented for exemplification purposes, and not for limitation purposes. It should be understood that structural and/or logical modifications could be made by someone of ordinary skills in the art without departing from the scope of the invention. Therefore, the scope of the invention is defined by the accompanying claims and their equivalents.

The electromagnetic force field disclosed herein, and an apparatus that incorporates it, includes a multilayered field including a first outer layer, which is a supercharged plasma window, connected to a power supply, and which is heated to temperatures high enough to vaporize metals. A second layer consisting of a curtain of high-energy laser beams, also connected to a power supply, and arranged in a lattice-like configuration, which may heat up objects that passed through it, causing the objects to vaporize. And, a third layer consisting of several layers of carbon nanotubes, which adds strength to the entire construct by being capable of repelling the objects or portions of those objects (e.g., projectiles) that are able to pass through the first two layers (e.g., plasma and laser) of the multilayered field.

FIG. 1 illustrates the working principle of a plasma field generator 100. As shown, in the basic form, the plasma field generator has two metal electrodes: a central rod-shaped cathode 101, and a cylindrical anode 102 (half shown only) that surrounds the cathode 101. When a high-current electric arc is struck between the anode 101 and cathode 101, as the cathode 101 heats up, it emits electrons, which collide with and ionize a propellant gas 103 to create plasma. A magnetic field 104 is created by the electric current returning to the power supply (not shown) through the cathode 101, just like the magnetic field that is created when electrical current travels through a wire. The self-induced magnetic field 104 interacts with the electric current flowing from the anode to the cathode (through plasma) to produce an electromagnetic (Lorentz) force that pushes the plasma out of the device/generator, thus, creating a plasma field. A magnet coil (not shown), external to the anode, may also be used to provide additional magnetic field to help stabilize and accelerate the plasma discharge.

Figure 2:
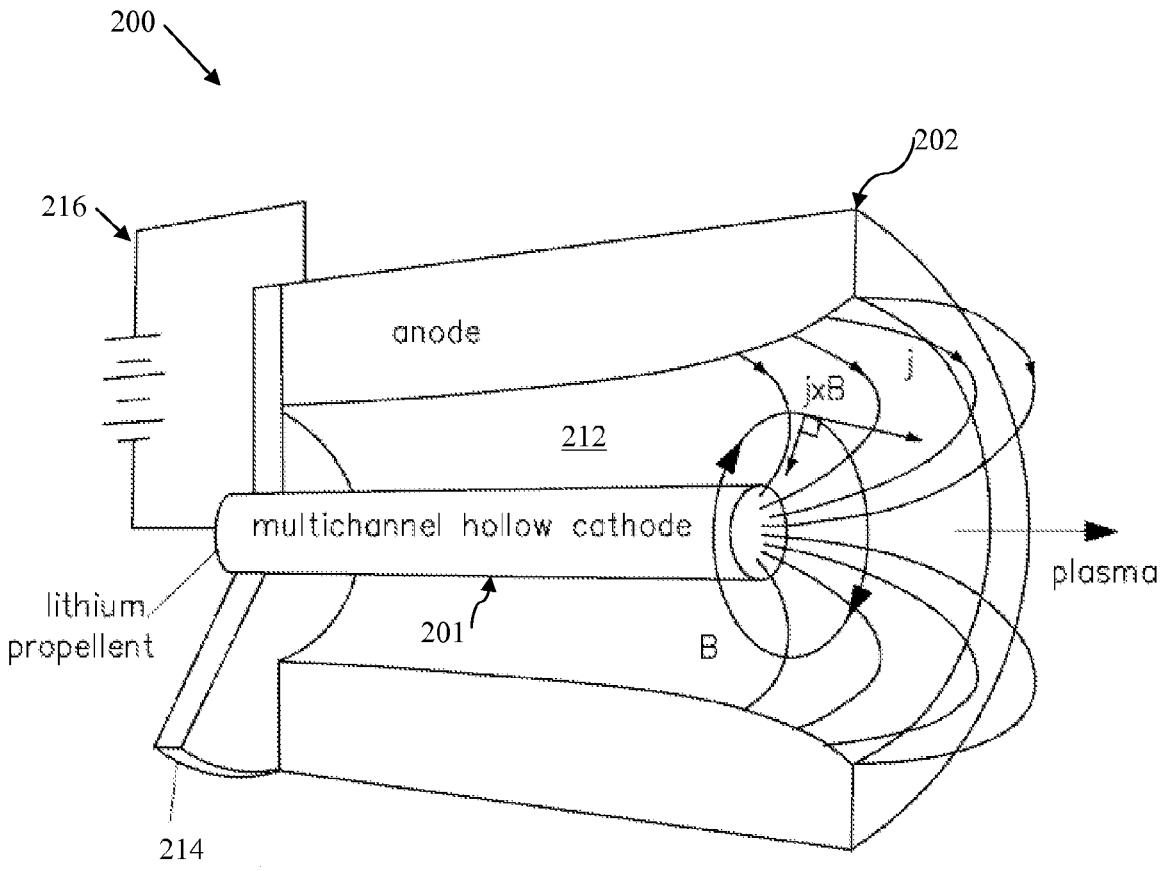
FIG. 2 illustrates an exemplary construction of an improved, self-field, coaxial, plasma field generator.

FIG. 2 illustrates an exemplary construction of an improved, self-field, coaxial, plasma field generator 200.

As shown in FIG. 2, this plasma generator utilizes a hollow cylindrical anode 202, which forms a discharge chamber 212, and a hollow or a multichannel hollow (for improved efficiency) cathode 201. As shown, the cylindrical anode 202 is open at one end (this is the end through which plasma is pushed out, thus, creating a plasma field), and closed at the other end with an insulator backplate 214, to prevent the plasma from exiting through that end. There are two electromagnets (not shown) inside the anode, that establish a direct current magnetic field which is primarily parallel to the thruster axis passing through the discharge chamber. A small angle of divergence between the axial and radial directions exists in the magnetic flux density.

All outside surfaces of the generator are coated with aluminum oxide to insulate them from plasma.

As shown a high voltage power source 216, powers the generator.

The plasma window may fill a volume of space with plasma which is confined by a magnetic shield. Plasma windows are generally heated to very high temperatures, but the temperature may vary depending upon the application.

Figure 3:
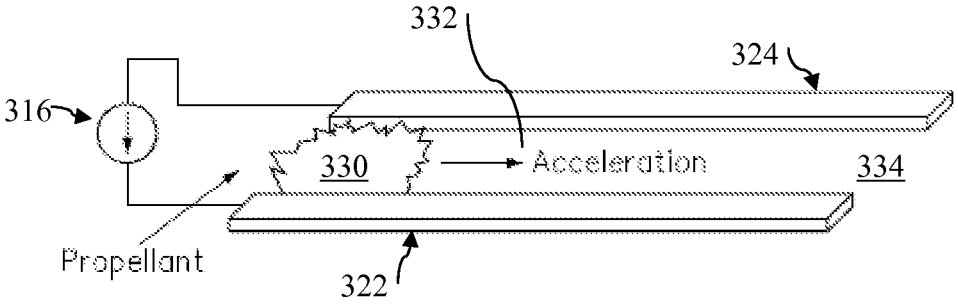
FIG. 3 depicts a schematic view of flow of plasma using Lorentz accelerator principle.

FIG. 3 depicts a schematic view of flow of plasma using Lorentz accelerator principle. As shown, from the current source 316, current flows into the nearer rail 322, through the plasma 330 and then back, through the far rail 324, to the current source 316. It is known that current through conductors causes magnetic field. Since the plasma 330 now carries the current, it has the same accelerating force as the magnetic field. This results in the plasma 330 being accelerated out through the end 334 of the channel 332 formed by the two electrodes 322 and 324, thus, providing a plasma force.

Figure 4:
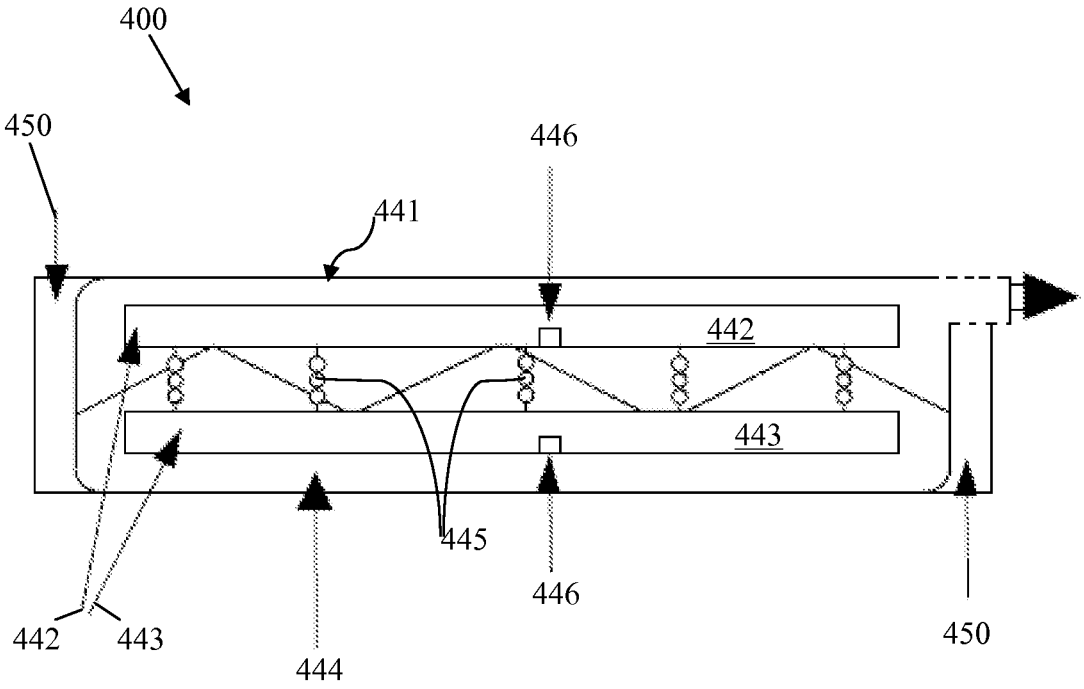
FIG. 4 depicts the schematic diagram of a gas discharge laser.

FIG. 4 depicts the schematic diagram of a gas discharge laser 400. As mentioned earlier, the second layer of the electromagnetic force field disclosed herein is a laser curtain. As shown, a gas discharge laser 400 includes a housing 441, with a 100% reflecting spherical mirror 450 at each end, and enclosing spaced-apart electrodes, 442 and 443, and a lasing gas (e.g., CO2, N, He) filling the cavity/space 444 available inside housing 441, including between electrodes 442 and 443. A laser resonator 445 extends between the spaced-apart electrodes 442 and 443. An RF power supply 446 provides RF power for creating a discharge in the lasing gas, causing laser radiation to be delivered by the laser resonator 445. The power of the output radiation is directly dependent on the RF power provided to the electrodes 442 and 443, and inversely dependent of the temperature of the gas discharge.

As mentioned earlier, a lasing gas such as CO2 can be adopted to produce the laser curtain. The laser may employ a pumping scheme which serves to excite the lasing gas uniformly, and thus, enhancing the transfer of pump energy into laser energy. In practice, a number of pumping schemes may be used such as, a flash bulb, or electronic pumping. Pumping with a coherent source like a laser allows picking a specific energy state transition to excite, which allows a finer control over the lasing wavelengths that the laser will operate in. For example, at 10.6 um, laser is totally invisible to the human eye.

Figure 5:
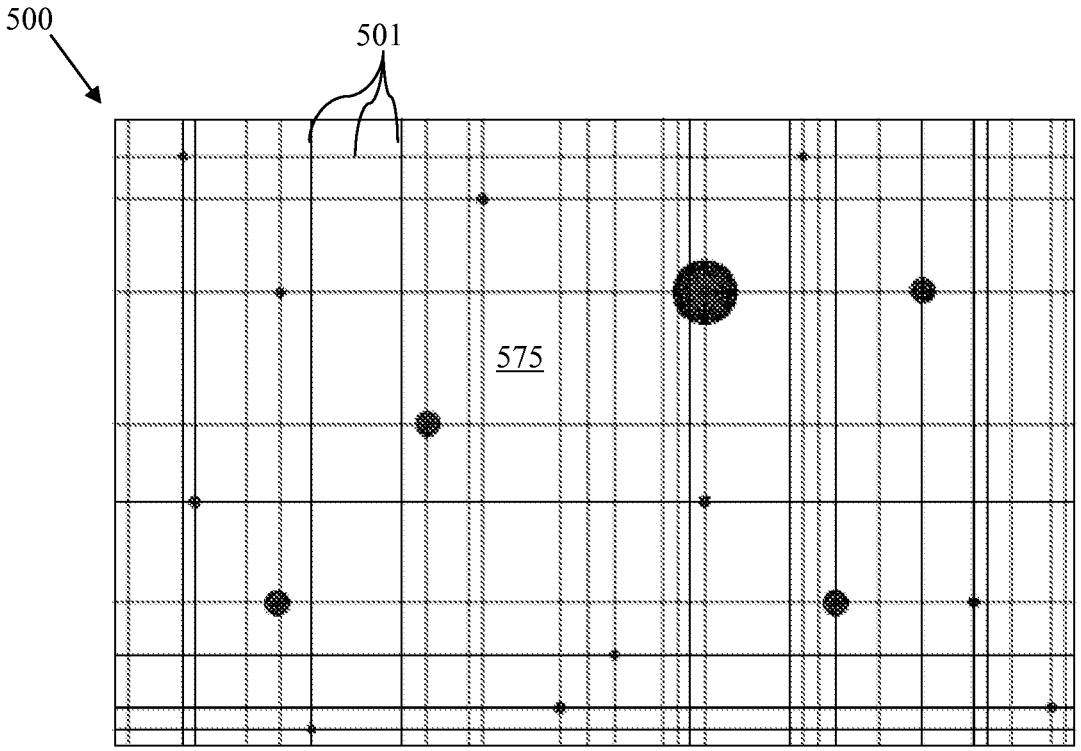
FIG. 5 depicts an exemplary second layer, laser curtain, of the electromagnetic force field.

FIG. 5 depicts an exemplary second layer, laser curtain 500, of the electromagnetic force field. As shown, there are multiple beams of laser 501 in the layer, to form a laser curtain 500. The laser curtain 500 may be formed by using many laser beams 501 simultaneously. Various laser frequencies can be used to improve laser curtain's efficiency (to vaporize an incoming projectile for example). If configured to have enough intensity, whenever an object passes through the laser curtain, the laser curtain heats up the object and vaporizes the metals in it (or other materials). Although not shown in FIG. 5, it is preferred that the laser beams 501 be equidistant in both directions of the laser curtain (e.g., vertically and horizontally) to prevent the creation of loopholes (e.g., 575) that would facilitate the passage through the laser curtain of an incoming object. In addition, the equal distance between the laser beams should be smaller than the expected size of the smallest incoming objects. Furthermore, for increased efficiency of the laser curtain, it is preferred to have minimum four beams (i.e., two beams in each of the two directions (e.g., two vertical beams and two horizontal beams)) in the path of an incoming object. As such, when selecting the distance between the beams, this aspect has to be considered as well.

Figure 6:
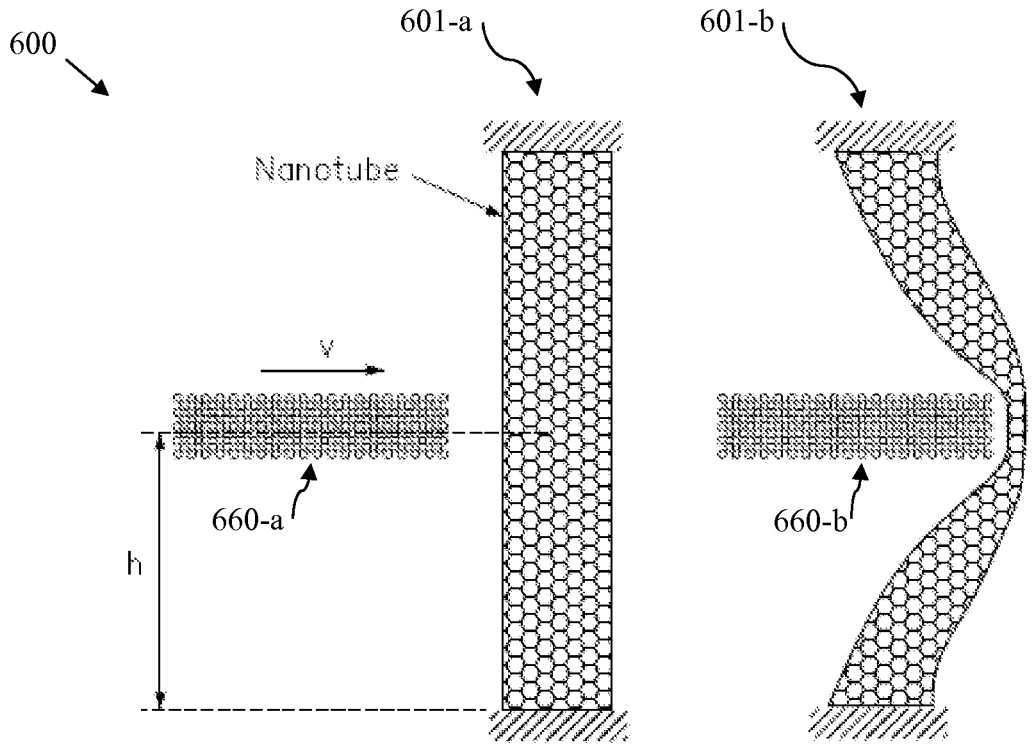
FIG. 6 depicts the molecular dynamics model of a carbon nanotube layer subjected to ballistic impact.

FIG. 6 depicts the molecular dynamics model 600 of a carbon nanotube layer subjected to ballistic impact. 601-*a* depicts the initial model, before impact. 601-*b* depicts a deformed model at its maximum energy absorption. As stated earlier, the third layer of the electromagnetic force field is made of carbon nanotubes (CNT). Carbon nanotubes are hollow cylinders made of carbon atoms that are one-billionth of a meter. For increased strength of the carbon nanotube layer, double walled carbon nanotubes may be used. In addition, for increased strength of the third layer of the electromagnetic force field, it is preferred that more than one CNT sheet is used (e.g., two or three CNT sheets). The CNT sheets may be positioned next to each other or spaced apart, to create the third layer of the electromagnetic force field.

When a projectile 660-*a*, 660-*b* strikes carbon nanotubes (see 601-*b* and 660-*b*), the fibers of these materials absorb and disperse the impact energy to successive layers of CNT to prevent the projectile 660-*b* from penetrating this third layer of the electromagnetic force field. The speed of the projectile 660-*b* decreases due to its energy loss when impacting a CNT (the energy is absorbed by the CNT), and becomes zero when the CNT absorbs and dissipates all the energy of the projectile.

Figure 7:
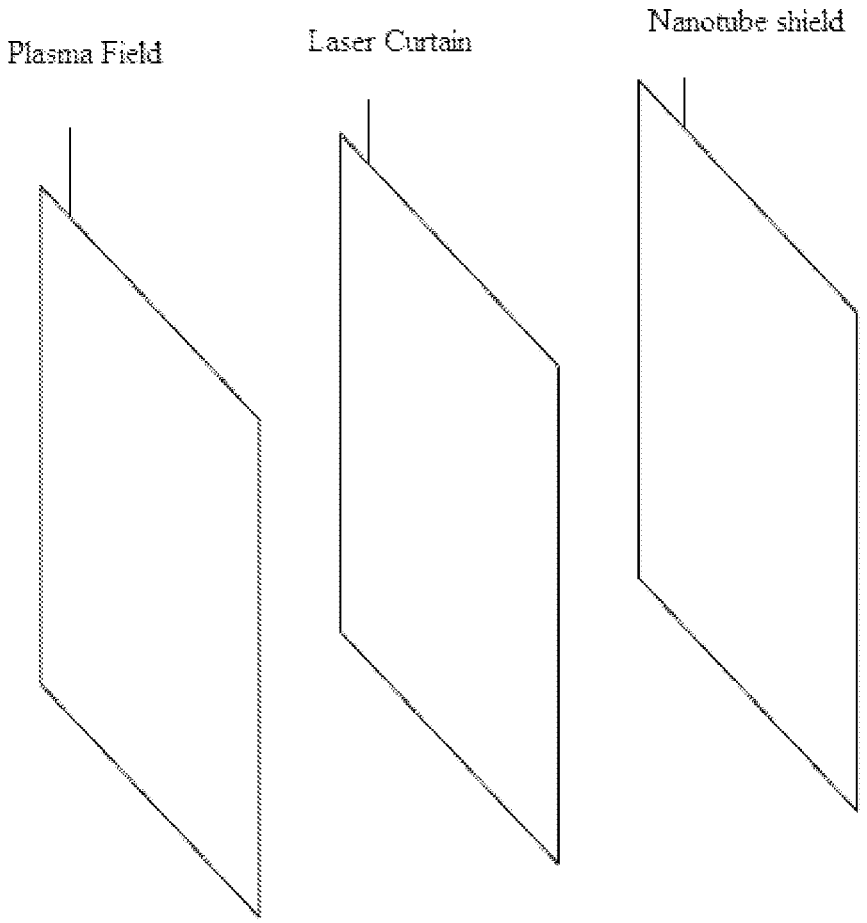
FIG. 7 depicts schematically the combination of the three layers (i.e., plasma field, laser curtain, and carbon nanotubes shield) that form an exemplary electromagnetic force field, according to an embodiment.

FIG. 7 depicts schematically the combination of the three layers (i.e., plasma field, laser curtain, and carbon nanotubes shield) that form the electromagnetic force field as described above. It should be understood that two layers may be enough to create an equivalent electromagnetic force field usable for similar applications as the three-layer field. For example, if the plasma layer is doubled strength-wise, the third layer of CNT may be eliminated as the second laser layer may be enough to vaporize the fewer objects or portions of objects that may escape the double-in-strength first plasma layer. Similarly, the laser layer may be eliminated, as the CNT layer may be enough to repel the fewer objects or portions of objects that may escape the double-in-strength first plasma layer.

It should also be understood that more than three layers may be used, as such configuration may increase the strength of the force field. For example, a four-layer force field may be used arranged in the following order: plasma layer—laser layer—plasma layer—CNT layer (last layer).

The electromagnetic force field disclosed herein may be used to protect designated assets (e.g., military assets such as a tank) against incoming objects such as projectile weapons.

It may be advantageous to set forth definitions of certain words and phrases used in this patent document. The term "couple" and its derivatives refer to any direct or indirect communication between two or more elements, whether or not those elements are in physical contact with one another. The terms "include" and "comprise," as well as derivatives thereof, mean inclusion without limitation. The term "or" is inclusive, meaning and/or. The phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like.

Although specific embodiments have been illustrated and described herein for the purpose of disclosing the preferred embodiments, someone of ordinary skills in the art will easily detect alternate embodiments and/or equivalent variations, which may be capable of achieving the same results, and which may be substituted for the specific embodiments illustrated and described herein without departing from the scope of the invention. Therefore, the scope of this application is intended to cover alternate embodiments and/or equivalent variations of the specific embodiments illustrated and/or described herein. Hence, the scope of the invention is defined by the accompanying claims and their equivalents. Furthermore, each and every claim is incorporated as further disclosure into the specification and the claims are embodiment(s) of the invention.

What is claimed is:

1. An electromagnetic force field configured to protect designated assets against incoming objects, comprising a plurality of layers, wherein each layer of the plurality of layers is a member of a group consisting of a supercharged plasma window, a curtain of high-energy laser beams arranged in a lattice-like configuration, wherein the laser beams are positioned at equal distance between each other and as such as to ensure that at least four laser beams are in the path of the smallest object, and a carbon nanotube (CNT) layer, wherein, the CNT layer comprises a plurality of CNT sheets.

2. The electromagnetic force field of claim 1, wherein the protection includes heating the objects to high temperatures such that the objects vaporize.

3. The electromagnetic force field of claim 1, wherein at least one layer of the plurality of layers consists of the CNT layer and the protection includes repelling objects by the use of the CNT layer.

4. The electromagnetic force field of claim 1, wherein the incoming objects are projectile weapons.

5. The electromagnetic force field of claim 1, wherein at least one layer of the plurality of layers consists of the supercharged plasma window, wherein the supercharged plasma window is obtained by generating the plasma using a coaxial plasma field generator and by confining the plasma by a magnetic shield.

6. The electromagnetic force field of claim 5, wherein at least one layer of the plurality of layers consists of the high-energy laser beams, wherein the high-energy laser beams are obtained using a gas discharge laser comprising a housing with a reflecting spherical mirror at each end, two spaced-apart electrodes, a lasing gas, and a laser resonator.

7. The electromagnetic force field of claim 6, wherein the force field consists of two layers, the supercharged plasma window as the first layer and the curtain of high-energy laser beams as the second layer.

8. The electromagnetic force field of claim 1, wherein the force field consists of two layers, the supercharged plasma window as the first layer and the plurality of CNT sheets as the second layer.

9. The electromagnetic force field of claim 6, wherein the force field consists of three layers, the supercharged plasma window as the first layer, the curtain of high-energy laser beams as the second layer and the plurality of CNT sheets as the third layer.

10. The electromagnetic force field of claim 6, wherein the force field consists of four layers, the supercharged plasma window for both, the first and the third layer, the curtain of high-energy laser beams as the second layer and the plurality of CNT sheets as the fourth layer.

* * * * *